United States Patent [19]

Feldmann et al.

[11] Patent Number: 4,798,074

[45] Date of Patent: Jan. 17, 1989

[54] ROLLING MILL STAND, ESPECIALLY FOR ROLLING STRIP

[75] Inventors: Hugo Feldmann, Alsdorf; Friedrich Hollmann, Grevenbroich; Horst Gärtner; Gerd Beisemann, both of Düsseldorf, all of Fed. Rep. of Germany

[73] Assignee: SMS Schloemann-Siemag Aktiengesellschaft, Dusseldorf, Fed. Rep. of Germany

[21] Appl. No.: 75,376

[22] Filed: Jul. 20, 1987

[30] Foreign Application Priority Data

Jul. 18, 1986 [DE] Fed. Rep. of Germany ..... 3624241

[51] Int. Cl.[4] ..... B21B 31/18; B21B 27/02

[52] U.S. Cl. ..... 72/247; 29/122; 72/199; 72/243

[58] Field of Search ..... 72/247, 245, 243, 241, 72/199, 21; 29/122

[56] References Cited

U.S. PATENT DOCUMENTS

| | | | |
|---|---|---|---|
| 4,440,012 | 4/1984 | Feldmann et al. | 72/247 X |
| 4,519,233 | 5/1985 | Feldmann et al. | 72/247 |
| 4,627,260 | 12/1986 | Benz | 72/247 |
| 4,656,859 | 4/1987 | Ginzburg | 72/247 X |
| 4,669,296 | 6/1987 | Bald | 72/247 X |
| 4,683,744 | 8/1987 | Ginzburg et al. | 72/247 X |

FOREIGN PATENT DOCUMENTS

| | | | |
|---|---|---|---|
| 0049798 | 9/1981 | European Pat. Off. . | |
| 2260256 | 8/1979 | Fed. Rep. of Germany . | |
| 2206912C3 | 4/1984 | Fed. Rep. of Germany . | |
| 3325823 | 1/1985 | Fed. Rep. of Germany | 72/247 |
| 0110401 | 6/1984 | Japan | 72/247 |
| 0036330 | 8/1985 | Japan | 72/243 |

*Primary Examiner*—Robert L. Spruill
*Assistant Examiner*—Steven B. Katz
*Attorney, Agent, or Firm*—Herbert Dubno

[57] ABSTRACT

The rolling mill or roll stand which makes a rolled product, particularly a rolled strip or strip, comprises a pair of working rolls, which if necessary are supported on a pair of supporting rolls or on a pair of the supporting rolls and intermediate rolls, and in which the working rolls and/or the supporting rolls and/or the intermediate rolls are axially slidable relative to each other. Each of the rolls of at least one of the pairs of rolls is provided with a curved contour extending to the roll body ends. These curved contours, sometimes on opposite sides, extend over only a portion of the rolled product width. The curved contour extends over the entire roll body length of each roll and has a shape such that both roll body contours entirely compliment themselves in a certain relative axial position. The working or intermediate rolls have the curve contours tapered to one of the roll body ends and widened toward the other of the roll body ends and are arranged slidable in opposite axial directions so that each of the tapered ends of the working rolls or intermediate rolls between a rolled product edge and the associated end of a supporting roll advantageously is held and aligned with each edge of the rolled product.

8 Claims, 3 Drawing Sheets

ROLLING MILL STAND, ESPECIALLY FOR ROLLING STRIP

FIELD OF THE INVENTION

Our present invention relates to a rolling-mill stand for making a rolled product, especially a comparatively flat rolled product such as rolled strip.

BACKGROUND OF THE INVENTION

A rolling-mill stand which makes a rolled product, particularly rolled strip, can comprise a pair of working rolls, which if necessary are braced by a pair of supporting rolls or by a pair of supporting rolls and a pair of intermediate rolls.

In this rolling-mill stand the working rolls and/or supporting rolls and/or intermediate rolls can be axially shiftable relative to one another and each roll of at least one of these pairs of rolls is provided with a curved contour extending to the roll body ends.

These curved contours are provided for both rolls of that roll pair, over a portion of the rolled product width. The curved contour extends over the entire roll body length of each roll and both roll bodies have a shape in which both roll body contours entirely complement each other in a certain relative axial position.

A rolling-mill stand of this type is described in European Patent 0 049 798. The roll gap shape is influenced by the features disclosed therein. A special position for the rolls in regard to the rolled product edges is not disclosed.

The working rolls are braced as usual over their length on intermediate or supporting rolls so that the roll force or load exerted by the supporting rolls is transferred over the entire length of the roll body. This has the result that the ends of the working rolls protruding laterally over the rolled product and thus not participating in the rolling process are bent by the roll forces exerted on them in the direction of the rolled product.

Furthermore in roll stands with stiff working rolls this damaging bending of the working rolls during rolling of a centrally rolled section or product causes a weakened rolling of the center portion of the rolled product and an excessively strong rolling of the edges of the rolled product. This effect is particularly noticeable in operation with varying rolling conditions such as sheet or strip temperature and varying roll forces as well as on rolling of different width products.

To eliminate this disadvantageous effect as set forth in German Patent 22 06 912 in six-high rolling-mill stands, the intermediate rolls are adjustable to fit the rolled product width so that one end of the effective roll body of the upper intermediate roll is placed in the vicinity of one rolled product edge while the opposing end of the effective roll body of the lower intermediate roll is placed in the vicinity of the other rolled product edge. Thus each working roll contains an end portion free from pressure due to the associated intermediate roll.

Furthermore in these rolling-mill stands, roll bending devices engage on the ends of the working rolls. The rolls are provided in the conventional way as symmetrically shaped and roll bending devices are provided. An end portion of the intermediate rolls is tapered conically in a comparatively short region with the disadvantage of a stepped change of the load distribution in the vicinity of the change in the angle of taper.

A more serious disadvantage of this known roll arrangement is that the effect of conical tapering and the axial adjustment of the intermediate rolls is limited except on the roll strip edges and the center region of the strip can in no way be influenced by it.

In German Patent 22 60 256 a roll stand with devices for axially shifting the working rolls in opposite directions on changing the rolled product width is disclosed so that one end of the working surfaces of a working roll is held between a rolled product edge and the end of the associated supporting roll.

Moreover intermediate rolls are also provided so that the upper intermediate roll is shiftable in the same direction as the lower working roll and the lower intermediate roll is shiftable in the same direction as the upper working roll. Also a conical tapering of only the ends of the intermediate rolls is provided with the above described disadvantageous effects.

OBJECT OF THE INVENTION

It is an object of our invention to provide an improved rolling-mill stand, especially an improved rolling-mill stand used to make a rolled strip, which obviates the foregoing drawbacks.

It is also an object of our invention to provide an improved rolling-mill stand, especially an improved rolling-mill stand which makes a rolled strip, in which the disadvantageous bending of the working rolls under roll forces is compensated for all rolled product widths employed.

It is another object of our invention to provide an improved strip rolling-mill stand in which the roll bending effect of the roll bending devices is augmented without need for interruption of the rolling operation.

It is a further object of our invention to provide an improved strip rolling-mill stand in which the required roll shifting motion is reduced.

SUMMARY OF THE INVENTION

These objects and others which will become more readily apparent hereinafter are attained, in accordance with our invention, in a rolling-mill stand which makes a rolled product particularly rolled strip, comprising a pair of working rolls, which if necessary are braced on a pair of supporting rolls or on a pair of supporting rolls and intermediate rolls, and in which the working rolls and/or supporting rolls and/or intermediate rolls are axially shiftable relative to each other and each roll of at least one of these pairs of rolls is provided with a curved contour extending from one roll body end to the other.

These curved contours extend, at least in part, beyond edges of the rolled product. The curved contour extends over the entire roll body length of each roll and has a shape such that both roll body contours are entirely complementary in a certain relative axial position.

By the contours of adjacent rolls or the same roll being complementary, we mean that when these ends or end portions are put together side by side they fit together exactly so that their longitudinal axes are substantially parallel.

According to a feature of our invention the working rolls have curved contours tapered to one of the roll body ends and diverging to the other one of the roll body ends and are shiftable in opposite axial directions so that the tapered one of the ends of the working rolls is held between a rolled product edge and an end of an associated one of the supporting rolls.

Alternatively in another embodiment of our invention the working rolls can have cylindrical or symmetrical roll bodies and the intermediate rolls have curved contours tapered to one roll body end and diverging toward the other roll body end and are shiftable in opposite axial directions in such a way that the tapered end of one of the intermediate rolls is held between one of the rolled product edges and one end of an associated one of the supporting rolls.

Advantageously the bulged portions of both working or intermediate rolls cooperate in such a way that the tapered or constricted segments of the bulged contours are positioned in the vicinity of both roll product edges.

There are a variety of possible forms of our invention for the first case in which the working rolls are contoured and their edges are aligned with the rolled product. In one example the working rolls have a curved contour comprising an approximately concave portion and an approximately convex portion with regard to the axial direction.

It has proved particularly suitable when an end of a working roll is held aligned with a rolled product edge, i.e. lies in a common vertical plane therewith.

Advantageously according to our invention also the intermediate rolls can be provided with a curved contour in the same way and can be axially shiftable in opposite directions like the working rolls so that one end of an intermediate roll is held in the vicinity of a rolled product edge.

Further the working and intermediate rolls working together can also be aligned on opposite rolled product edges, although alternatively they can be aligned on the same rolled product edge.

According to the second major alternative form of our invention the working rolls are cylindrical or symmetrical, the intermediate rolls are contoured and the tapered end of an intermediate roll is held between a rolled product edge and the end of the associated supporting roll. Using an S shape cross section for the intermediate rolls instead of the cylindrical shape allows the required sliding motion to be reduced up to about 60% with the same effect for the same strap or sheet width and roll force.

While with cylindrical intermediate rolls the pressing force between the supporting rolls and the intermediate rolls and/or the intermediate rolls and the working rolls climbs to a value which according to the strap or strip width reaches 1.3 to 1.4 times the specific roll force (linear load), in contrast with the S shape cross section intermediate rolls the pressing force can be reduced about 20%. Instead of load jumps from a maximum value to zero at the ends of the intermediate roll bodies one maintains a continuous load gradient, e.g. over a distance of about 400 mm.

The intermediate rolls like the working rolls in the examples above can comprise an approximately concave portion and an approximately convex portion in regard to their axial directions so that the end of an intermediate roll can be held aligned advantageously on a rolled product edge. In this axial position of the rolls the tapered portion of both intermediate rolls acts on each rolled product edge simultaneously whereby the load distribution is particularly satisfactory in the edge regions of the rolled product.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
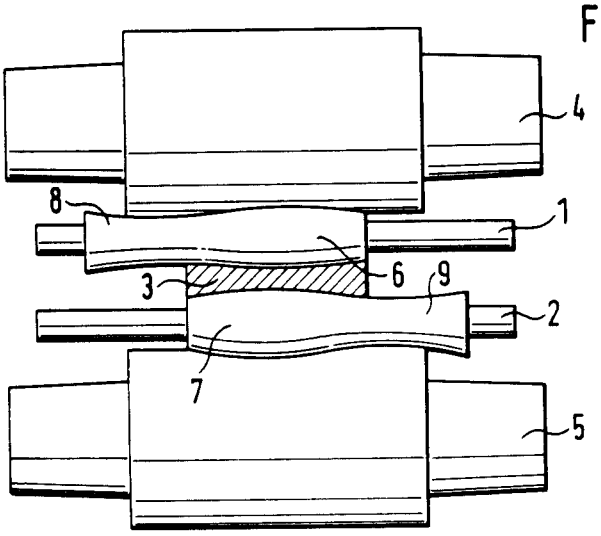
FIG. 1 is a schematic cross sectional view of a four-high rolling-mill stand according to our invention with shiftable contoured working, rolls in an edge-aligned configuration.

As is apparent from FIG. 1 two working rolls 1, 2 positioned substantially vertically over each other and which directly roll a rolled product are held in a known way by not illustrated structural elements mounted in a roll stand.

The working rolls 1,2 are braced by an upper and a lower supporting roll 4, 5.

Each of the working rolls 1, 2 is tapered at one end, i.e. the end 6 of the working roll 1 and the other end 7 of the other working roll 2 have a bulged shape tapered toward the end of the roll body while their opposing ends 8, 9 have a complementary shape.

As a whole the cross section through the working rolls 1, 2 can be considered as being singly S-shaped. The working rolls 1, 2 have at one of their ends pins, on which couplings for connection to drive mechanisms (not shown) are provided.

The bulged tapered ends 6, 7 of the working rolls 1, 2 are positioned in the vicinity of the edges 3*e* of the rolled strip 3*s* by axial shifting. In this configuration large roll pressures on the rolled product edges 3*e* of the rolled product 3 are avoided.

When the rolled product width changes, a sufficiently constant cross section of the strip can be attained by merely shifting the working rolls in the axial direction by coupling each roll with the unillustrated shifting drive so that one of the tapered ends 6, 7 of these rolls 1, 2 is placed in the vicinity of one of the rolled product edges 3*e*.

Figure 2:
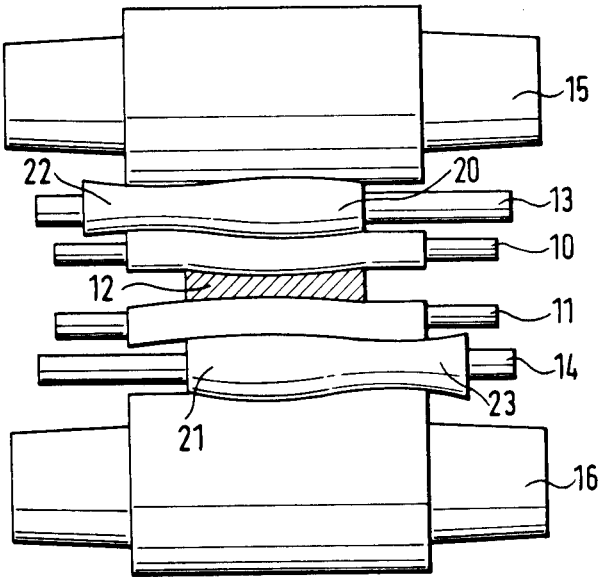
FIG. 2 is a schematic cross sectional view of a six high rolling-mill stand according to our invention with cylindrical working rolls and axially shiftable contoured intermediate rolls in an edge aligned configuration.

FIG. 2 shows two working rolls 10 and 11 positioned substantially directly one over the other which roll the rolled product 12 and in a known way are held in nonillustrated structural members mounted in a roll stand.

The two intermediate rolls 13, 14 bracing both working rolls 10, 11 are so arranged that their axes are positioned substantially over and/or under the axes of the working rolls Further each of the intermediate rolls 13, 14 is tapered to one end, i.e. the end 20 of the intermediate roll 13 and the other end 21 of the other intermediate roll 14 have a bulged shape which is constricted in the direction of the end of the roll body while the opposing ends 22, 23 have a complementary shape. On their ends the intermediate rolls 13, 14 have pins on which couplings for connection to nonillustrated drive mechanism are mounted.

Also in this arrangement for the intermediate rolls 13, 14 large roll pressures on the rolled product edges 12*e* are avoided. When similarly one of the ends of the working rolls 10, 11 is not braced by the supporting rolls also an effective bowing under load or bending of the working rolls 10,11 can be effected as a result of action by nonillustrated roll bending devices.

Compensation of small changes occurs by known bending devices which respond quickly because of their smaller construction and which do not act excessively on the bearing and roll pins. When the rolled product width changes a sufficiently constant cross section of the strip can be attained by shifting the intermediate rolls 13, 14 in the axial direction by the not illustrated coupled shifting drive so that the tapered ends 20, 21 of these rolls are positioned in the vicinity of one of the rolled product edges 12*e*.

By hindering the bowing under load or bending of the working rolls 10, 11 caused by the roll forces and expanding the effective length of the roll bending a rolled strip or rolled product of constant cross section results despite changes in the rolled product width.

Figure 3:
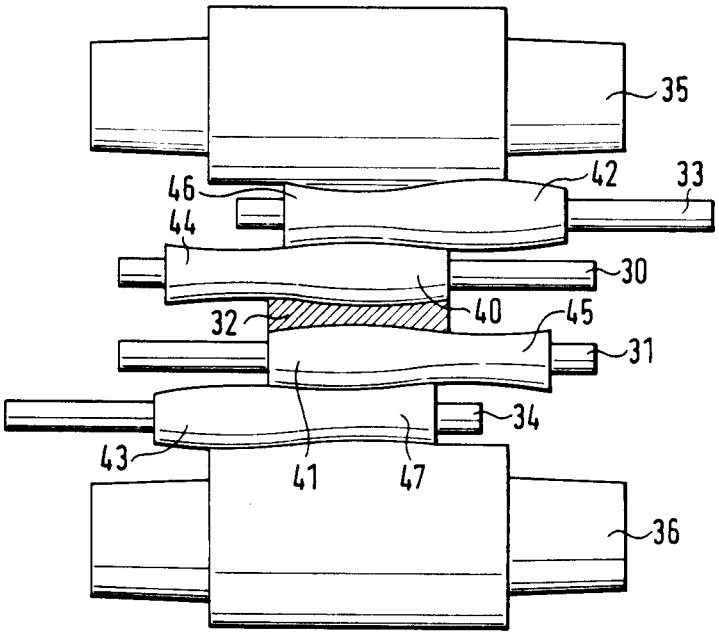
FIG. 3 is a schematic cross sectional view of a six high rolling-mill stand according to our invention with shiftable contoured working rolls and contoured intermediate rolls in an edge aligned configuration.

FIG. 3 shows (like FIG. 2) two working rolls 30, 31 positioned over each other however these working rolls 30, 31 are contoured. The intermediate rolls 33, 34 supporting both the working rolls 30, 31 are so arranged that their axes are over and/or under the axes of the working rolls 30, 31. The intermediate rolls 33, 34 are braced by an upper and lower supporting roll 35, 36. Further each of the working and intermediate rolls 30, 31; 33, 34 are tapered at one end whereby the ends 40, 41, 42, 43 have a bulged shage and are tapered toward the roll body ends while the opposing ends 44, 45, 46, 47 are complementarily shaped. The working and intermediate rolls 30, 31; 33, 34 have pins on one of their ends on which couplings for connection of an not illustrated drive mechanism are mounted.

In the roll stand according to our invention sufficient further space remains about the working rolls so that the upper and lower press mechanism, stripper or wiper and cooling devices may be positioned sufficiently close to the working rolls.

Figure 4:
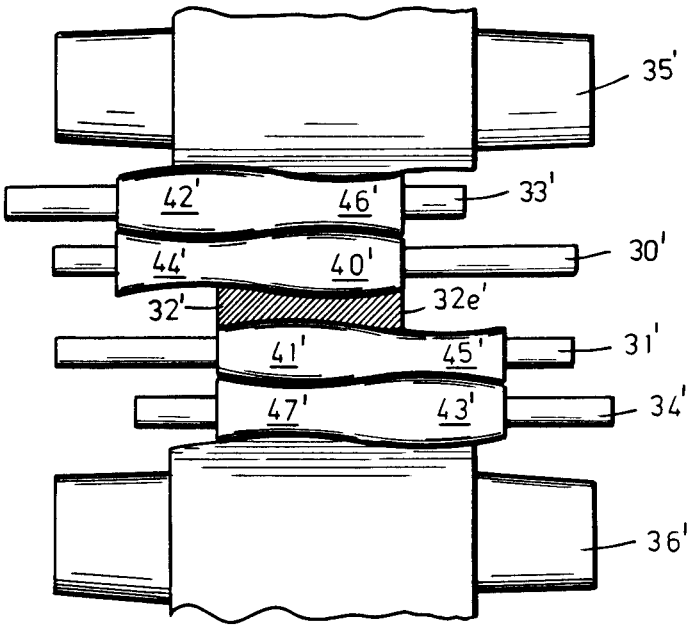
FIG. 4 is a schematic cross sectional view of a six high rolling-mill stand according to our invention with shiftable contoured working rolls and contoured intermediate rolls in an edge aligned configuration in which working rolls and intermediate rolls working together are aligned on the same rolled product edge.

FIG. 4 shows an additional embodiment of our invention similar to the embodiment of FIG. 3. A six high rolling-mill stand with shiftable intermediate rolls 33', 34' and working rolls 30', 31' is shown. Both the working rolls 30', 31' and intermediate rolls 33',34' are contoured having approximately concave 44', 45', 46', 47' and convex portions 40', 41' and 42', 43'. In this example however the working roll 30' or 31' and intermediate roll 33' or 34' working together, i.e. on the same side of the rolled product 32', are aligned on one and the same rolled product edge 32'*e* whereas in the example of FIG. 3 they are aligned on rolled product edges 32*e* on opposite sides of the rolled product.

The features according to our invention are not limited to the embodiments shown in the drawing. Many varying curved contours of working and intermediate rolls and also supporting rolls are also possible within the scope of our invention.

We claim:

1. A strip-rolling mill comprising a multiplicity of rolls including a pair of working rolls defining a rolling gap between them in which strip having opposite longitudinal edges is rolled, and at least one pair of other rolls bracing said working rolls, at least the rolls of one of said pairs being shiftable in opposite axial directions relative to one another, each of said rolls having a roll body of a length greater than a width of said strip between said edges and pins extending from opposite ends of the respective body with which the respective roll is journaled and driven, the bodies of at least said one of said pairs of rolls having contours with a constant curvature from one roll body end to an opposite roll body end with a bulging portion tapering to one roll body end and a concave portion diverging to an opposite roll body end so that said portions are complementary to one another and said contours are complementary to one another, one of the roll bodies having said contours having one of its ends aligned and coplanar with one of said longitudinal edges of said strip and the other of the roll bodies having said contours having its opposite end aligned and coplanar with the other of said longitudinal edges of said strip.

2. The strip-rolling mill defined in claim 1 wherein said roll bodies having said contours are the roll bodies of said pair of working rolls and said the other pair of rolls support each end of the working roll bodies aligned with a longitudinal edge of said strip.

3. The strip-rolling mill defined in claim 2 wherein said roll bodies of the rolls of the other pair each have contours with a constant curvature from one roll body end to an opposite roll body end with a bulging portion tapering to one roll body end and a concave portion diverging to an opposite roll body end so that said portions of said roll bodies of said other pair are complementary to one another and said contour roll bodies of said other pair are complementary to one another.

4. The strip-rolling mill defined in claim 3 wherein said rolls of said other pair are axially shiftable oppositely with respect to one another and are shiftable relative to the working rolls braced thereby.

5. The strip-rolling mill defined in claim 4 wherein said multiplicity of rolls includes a pair of backup rolls respectively braced against the rolls of said other pair.

6. The strip-rolling mill defined in claim 3 wherein said rolls of said other pair are respectively complementary to the working rolls braced thereby and are positioned so that corresponding ends of the roll bodies of each working roll and a roll of the other pair are coplanar and aligned with a respective longitudinal edge.

7. The strip-rolling mill defined in claim 6 wherein said multiplicity of rolls includes a pair of backup rolls respectively braced against the rolls of said other pair.

8. The strip-rolling mill defined in claim 1 wherein said working rolls are the rolls of the other pair and the roll bodies of said working rolls are symmetrical in contour to opposite sides of vertical median planes through said working rolls perpendicular to axes of said working rolls, said working rolls overhanging said longitudinal edges of said strip, said multiplicity of rolls including a pair of backup rolls respectively braced against the rolls of said one of said pairs.

* * * * *